US005094648A

United States Patent [19]

Turner

[11] Patent Number: 5,094,648

[45] Date of Patent: Mar. 10, 1992

[54] TORSO SUPPORT FOR PREGNANT WOMEN

[76] Inventor: Linda L. Turner, 406 Entrada Dr., J-10, Golden, Colo. 80401

[21] Appl. No.: 678,697

[22] Filed: Apr. 1, 1991

[51] Int. Cl.[5] ..... A41C 1/00; A41C 1/18; A41D 1/20

[52] U.S. Cl. ..... 450/155; 450/7; 2/73; 2/106; 2/107; 2/109

[58] Field of Search ..... 2/67, 73, 106, 107, 2/117, 109, 110, 69; 450/1, 7, 13, 19, 14, 104, 117, 155, 154

[56] References Cited

U.S. PATENT DOCUMENTS

| | | | |
|---|---|---|---|
| 1,556,075 | 10/1925 | Cadieux | 2/73 |
| 1,567,793 | 12/1925 | Ferris | 2/73 X |
| 1,807,486 | 5/1931 | Martin | 2/67 |
| 2,427,868 | 9/1947 | Manson | 2/73 |
| 2,585,567 | 2/1952 | Marin | 2/73 X |
| 2,763,009 | 9/1956 | Blatt | 450/104 |
| 3,304,941 | 2/1967 | Chubby | 450/104 |
| 3,542,033 | 11/1970 | Tenusiak | 450/117 X |
| 4,494,546 | 1/1985 | Steiman | 2/67 X |
| 4,746,318 | 5/1988 | Moyer | 450/155 |
| 4,836,824 | 6/1989 | Seering et al. | 450/155 |
| 4,976,653 | 12/1990 | White | 450/155 |

FOREIGN PATENT DOCUMENTS

| | | | |
|---|---|---|---|
| 10443 | of 1927 | Australia | 2/67 |
| 12523 | of 1929 | Australia | 2/67 |
| 0778885 | 3/1935 | France | 450/103 |
| 1580222 | 9/1969 | France | 2/67 |

OTHER PUBLICATIONS

Product Literature for The Reenie Maternity Belt by Leading Lady References U.S. Pat. No. 4,557,268.

Product Literature for the Prenatal Cradle apparently the same article as disclosed in U.S. Pat. No. 4,836,824.

*Primary Examiner*—Werner H. Schroeder

*Assistant Examiner*—Jeanette E. Chapman

[57] ABSTRACT

A torso support for pregnant women includes abdominal, breast and back support panels and laterally extending upper and lower elastic strips. The upper strip extending along a junction of the lower edge of the breast support panel and the upper edge of the abdominal support panel, and the lower elastic strip extending around a bottom edge of the abdominal support panel adjacent a waist opening of the torso support, are stretchable in only a lateral direction. A pair of shoulder straps extending from an upper portion of the breast support panel to a central upper region on a back of the torso support define neck and shoulder openings. The back support panel has a hexagonal configuration and tapers in width from a widest upper portion to a narrower lower portion. Side edges of the back support panel extend in conformance with arcuate peripheral edge portions of the shoulder openings. Ends of the upper strip are secured to central regions of lateral edges of the back support panel. A bottom arcuate edge of the back support panel is sewn to the lower elastic strip. The breast and abdominal support panels are formed from a woven cotton blend fabric material stretchable in longitudinal and lateral directions. The back support panel is formed from a woven fabric material stretchable in only a longitudinal direction. The torso support is worn as an undergarment or outergarment and provides support for the lower abdomen, back and breasts of a pregnant woman.

14 Claims, 3 Drawing Sheets

TORSO SUPPORT FOR PREGNANT WOMEN

BACKGROUND OF THE INVENTION

The present invention relates to torso supports for pregnant women, and more particularly pertains to an improved torso support designed to be worn as an undergarment or outergarment for supporting the lower abdomen, back and breasts of a pregnant woman. Physiological changes which occur during pregnancy place a great deal of strain on the body of a woman, and can result in chronic debilitating physical injury, as described in U.S. Pat. No. 4,836,824, the entire disclosure of which is hereby incorporated by reference herein. In particular, the lower abdomen, breasts, and back of a pregnant woman require increased support to prevent muscle strain and possible skeletal dislocation.

SUMMARY OF THE INVENTION

In order to achieve these and other objects of the invention, the present invention provides an improved torso support for pregnant women which includes an abdominal support panel, a breast support panel, a back support panel, and substantially laterally extending upper and lower elastic strips. The upper elastic strip extends along a junction of the lower edge of the breast support panel and the upper edge of the abdominal support panel. The lower elastic strip extends around a bottom edge of the abdominal support panel adjacent a waist opening of the torso support. A pair of shoulder straps extend from an upper portion of the breast support panel to a central upper region on a back of the torso support. The shoulder straps define a head and neck opening and left and right shoulder openings. The back support panel has a generally hexagonal configuration and tapers in width from a widest upper portion to a narrower lower portion. Arcuate side edges of the back support panel extend in close conformance with arcuate peripheral edge portions of respective left and right shoulder openings. Opposite ends of the upper elastic strip are secured respectively to a central region of left and right lateral edges of the back support panel. A bottom arcuate edge of the back support panel is sewn to the lower elastic strip. The breast and abdominal support panels are formed from a woven cotton blend fabric material stretchable in longitudinal and lateral directions. The back support panel is formed from a woven fabric material stretchable in only a substantially longitudinal direction, while the upper and lower elastic strips are stretchable in only a substantially lateral direction. The torso support is worn as an undergarment or outergarment and provides support for the lower abdomen, back and breasts of a pregnant woman.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
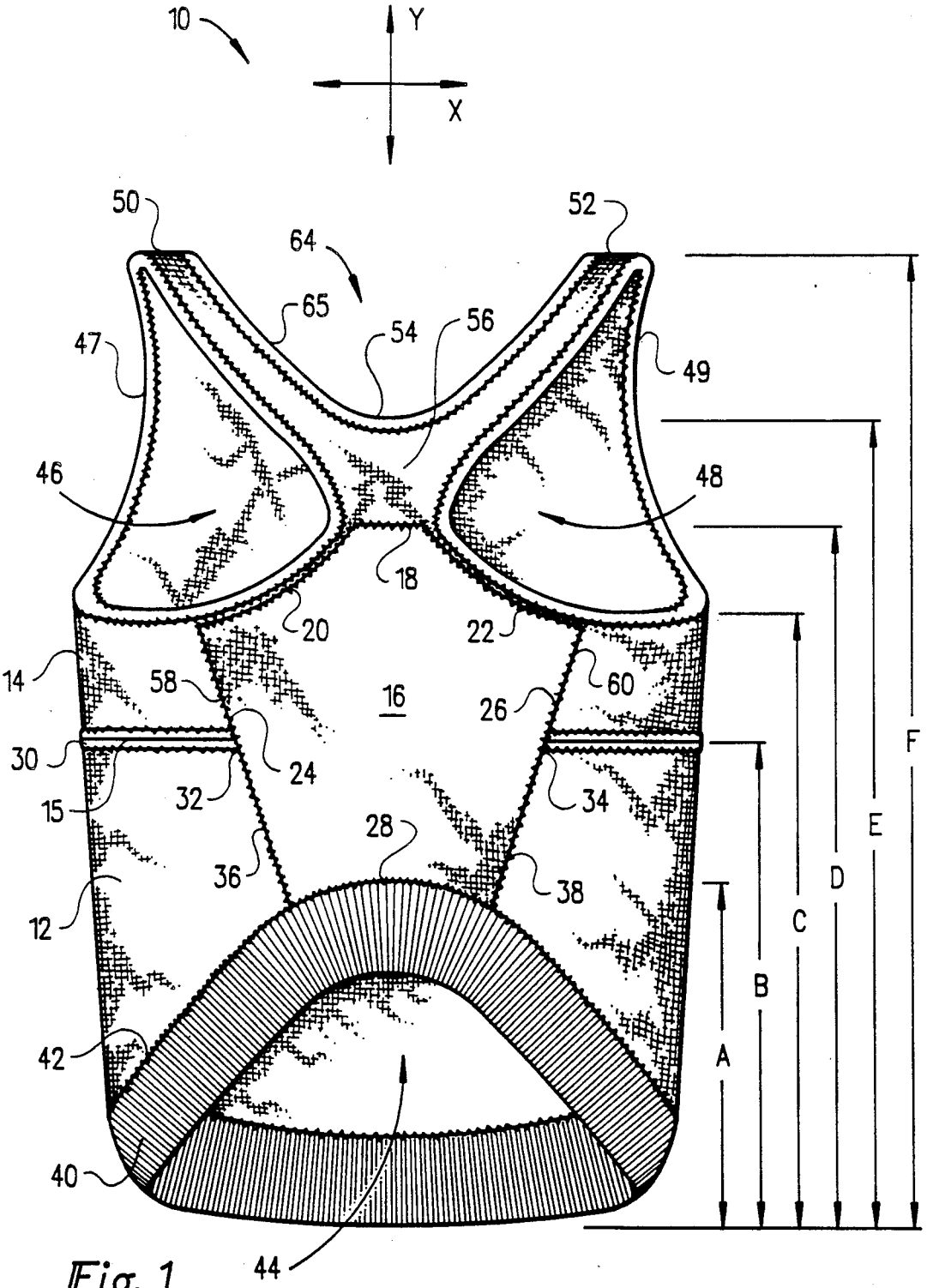
FIG. 1 is a rear elevational view of the torso support for pregnant women according to the present invention.
Figure 2:
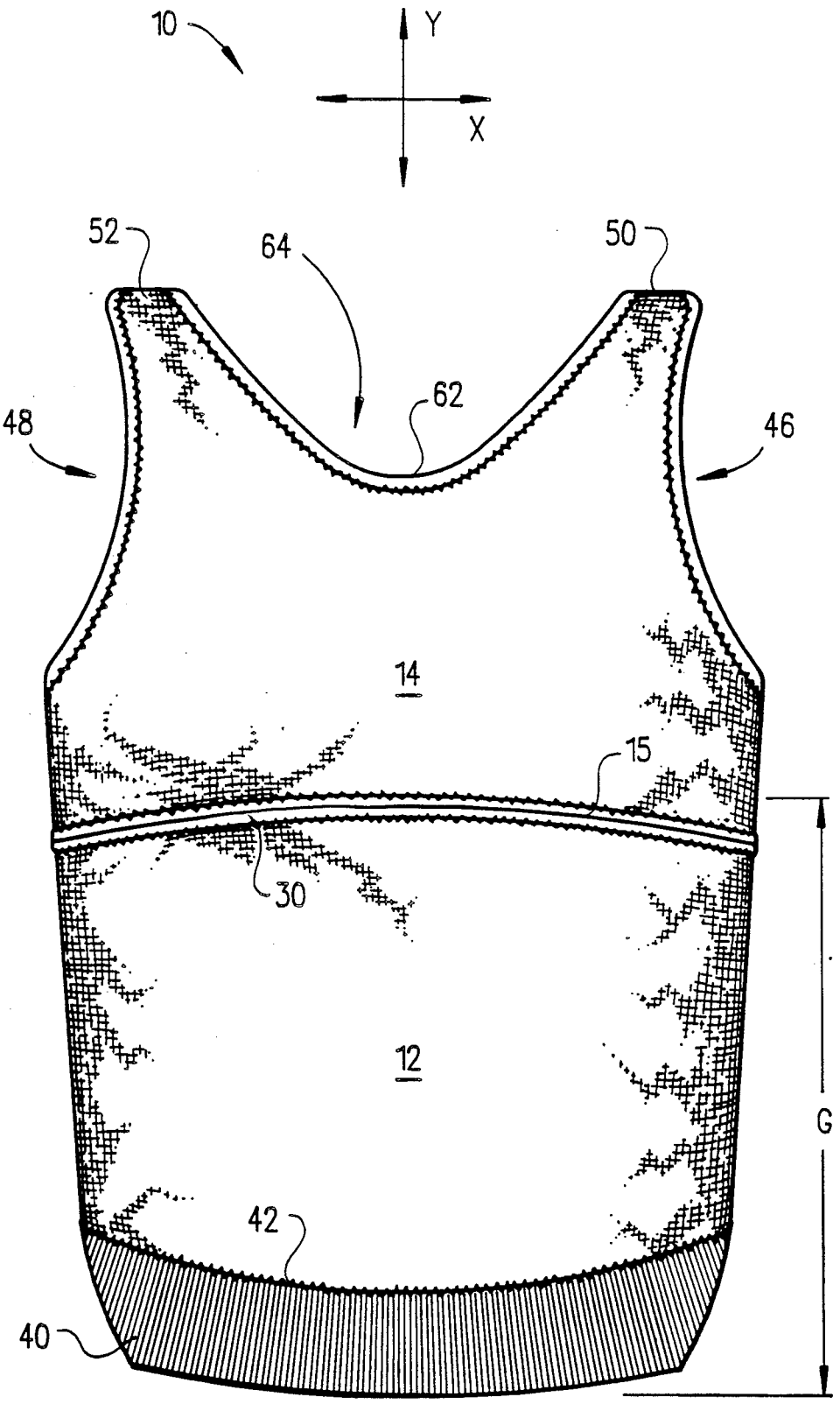
FIG. 2 is a front elevational view illustrating the torso support for pregnant women according to the present invention.

Referring now to the drawings, wherein like reference numerals designate corresponding structure throughout the views, and referring in particular to FIGS. 1 and 2, an improved torso support for pregnant women 10 according to a first preferred embodiment of the invention takes the form of an undergarment having front and back portions and includes an abdominal support panel 12, a breast support panel 14, and a back support panel 16. A substantially laterally extending lower edge of the breast support panel 14 is sewn to a substantially laterally extending upper edge of the abdominal support panel 12 at a junction 15. While the various components of the torso support 10 are preferably assembled by sewing, various conventional alternative securement methods may also be employed without departing from the scope of the present invention.

The abdominal support panel 12 and the breast support panel 14 are both formed from a woven cotton blend fabric material stretchable in both longitudinal Y and lateral X directions. A preferred cotton blend fabric composition is eighty-six percent cotton, seven percent LYCRA (TM), and seven percent nylon. A back support panel 16 is preferably formed from an elastomeric woven material sold under the name SATIN LASTEX (TM) by Sew Easy Lingerie.

As can be appreciated from FIG. 1, the back support panel 16 has a generally hexagonal configuration and includes a top edge 18 extending substantially laterally across a central upper region on the back of the torso support 10, and disposed between arcuate left 20 and right 22 side edges. The back support panel 16 possesses substantially straight, downwardly converging left 24 and right 26 lateral edges extending respectively from the arcuate left 20 and right 22 side edges to a bottom arcuate edge 28. The woven fabric material utilized for the back panel 16 is stretchable preferably only in a substantially longitudinal direction Y, and not in a lateral direction X.

Figure 3:
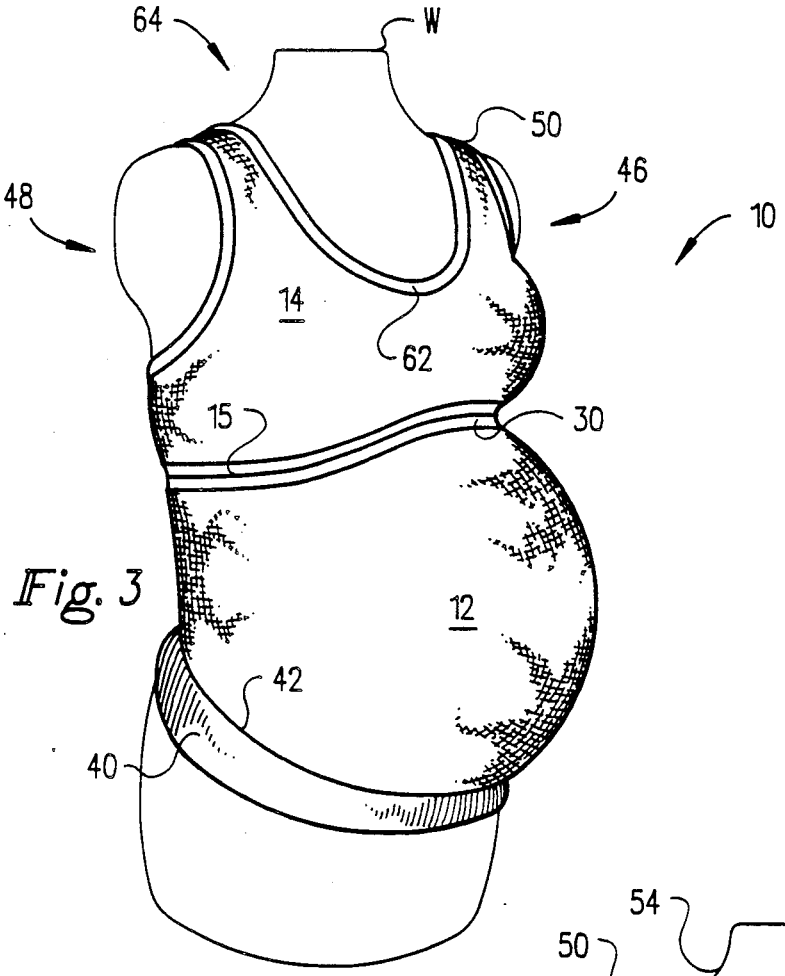
FIG. 3 is a perspective view illustrating the torso support for pregnant women according to the present invention disposed on a form representing the physique of a pregnant woman.
Figure 4:
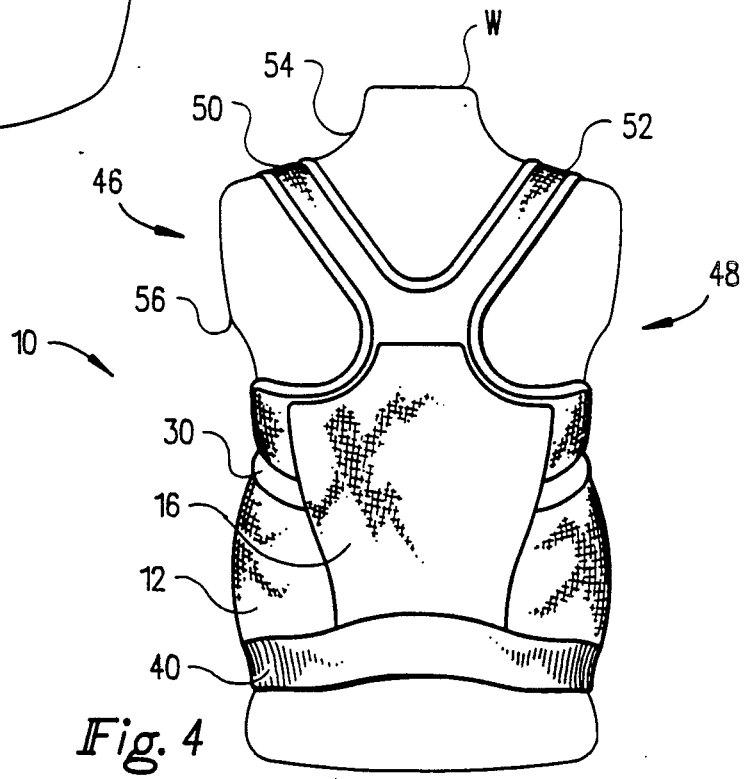
FIG. 4 is a rear elevational view of the torso support for pregnant women according to the present invention disposed on a form representing the physique of a pregnant woman.

As best shown in FIGS. 1 and 2, an upper elastic strip 30 extends along the junction 15 of the abdominal support panel 12 and the breast support panel 14, dividing the garment into an upper breast support region and a lower abdominal support region. The upper elastic strip 30 is of a conventional elastic material, one suitable form being available from Sew Easy Lingerie. The upper elastic strip 30 is stretchable preferably only in a substantially lateral direction X and not in a longitudinal direction Y. The upper elastic strip 30 extends around the front and side portions of the torso support 10, as can best be appreciated from FIGS. 2, 3 and 4, and is secured at 32 and 34 to the left lateral edge 24 and right lateral edge 26 of the back support panel 16, as shown in FIG. 1. As illustrated in FIGS. 1, 2 and 3, the abdominal support panel 12 tapers in width from a widest central front portion toward narrowest opposite left 36 and right 38 side edges. The left 36 and right 38 side edges of the abdominal support panel 12 are sewn, respectively, to lower portions of the left 24 and right 26 lateral edges of the back support panel 16, as shown in FIG. 1.

As depicted in FIGS. 1, 2 and 3, the breast support panel 14 also tapers in width from a widest central front portion, shown in FIG. 2, toward narrowest left 58 and right 60 side edges, shown in FIG. 1. As can be appreciated from FIG. 1, the left 58 and right 60 side edges of the breast support panel 14 are sewn respectively to upper portions of the left 24 and right 26 lateral edges of the back support panel 16.

As shown in FIGS. 1–4, a lower elastic strip 40 is sewn around a bottom edge 42 of the abdominal support panel 12. The lower elastic strip 40 has a preferred width of two inches, substantially greater than the width of the upper elastic strip 30, and is formed from a conventional elastic material, with one suitable type being available from Sew Easy Lingerie. The lower elastic strip 40 is stretchable preferably only in a substantially lateral direction X, extending along the edge 42 of the abdominal support panel 12. The lower elastic strip 40 defines a waist opening 44 which allows a slip-on application of the torso support 10 by a wearer.

Left 46 and right 48 shoulder holes have respective elastic peripheral edge borders 47 and 49, each stretchable in only a direction substantially along the peripheral edge of the respective opening. Left 50 and right 52 shoulder straps extend from an upper front portion of the breast support panel 14 to an intersection at a central upper region 56 on a back of the torso support 10, as shown in FIG. 1. The torso support 10 is formed with a scoop back 54 (FIG. 1) and scoop front neck 62 (FIG. 2), defining the bounds of a head an neck receiving opening 64. The neck opening 64 is surrounded by an elastic peripheral edge border 65.

While the torso support 10 of the present invention may be formed in a variety of different sizes to accommodate various different individual proportions, representative example dimensions are shown in the following table:

| Reference Letter | Dimension Inches | Description |
|---|---|---|
| A | 7 | Bottom front edge to upper back edge of lower elastic strip 40 |
| B | 10.5 | Bottom front edge of strip 40 to junction 15 at back of torso support 10 |
| C | 14 | Bottom front edge of strip 40 to corners 22, 26 and 20, 24 of back panel 16 |
| D | 16 | Bottom front edge of strip 40 to top edge 18 of back panel 16 |
| E | 18 | Bottom front edge of strip 40 to low point of scoop back 54 |
| F | 21 | Bottom front edge of strip 40 to top of shoulder straps 50 and 52 |
| G | 12.5 | Bottom front edge of strip 40 to high point of upper edge of upper elastic strip 30 |

As can be appreciated from FIGS. 1–4, with reference to dimension A, the lower elastic strip 40 extends from beneath the lower abdomen of a pregnant wearer W to a higher position at the small of the wearer's back. Similarly, it will be noted that the upper elastic strip 30 and lower elastic strip 40 converge from a widest separation at the central front portion of the abdominal support panel 12 to a smallest separation at the back of the torso support 10, as shown in FIG. 1. This construction, along with the configuration of the shoulder straps 50 and 52, provides support for the breasts, lower abdomen and back of a pregnant wearer W, resulting in a substantial straightening of the normally stooped posture of such individuals, thus minimizing the chances of muscular strain and skeletal dislocation.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A torso support for pregnant women, comprising:

an abdominal support panel;

a breast support panel possessing a substantially laterally extending lower edge secured proximate a substantially laterally extending upper edge of said abdominal support panel;

an upper elastic strip extending along the junction of said lower edge of said breast support panel and said upper edge of said abdominal support panel;

a substantially hexagonal back support panel;

left and right side edges of said breast support panel secured respectively to upper portions of left and right lateral edges of said back support panel;

left and right side edges of said abdominal support panel secured respectively to lower portions of said left and right lateral edges of said back support panel;

opposite ends of said upper elastic strip secured respectively to said left and right lateral edges of said back support panel;

a pair of shoulder straps extending from a front of said breast support panel to a central upper region on a back of said torso support, defining neck and left and right shoulder openings, said central upper region of said torso support secured to said back support panel; and a lower elastic strip secured around a bottom edge of said abdominal panel and to said back support panel, defining a waist opening.

2. The torso support for pregnant women of claim 1, wherein said lower elastic strip is secured to a bottom edge of said back support panel.

3. The torso support for pregnant women of claim 1, wherein said abdominal support panel and said breast support panel are formed from a woven fabric material stretchable in longitudinal and lateral directions.

4. The torso support for pregnant women of claim 3, wherein said back support panel is formed from a material stretchable in only a substantially longitudinal direction.

5. The torso support for pregnant women of claim 1, wherein said back support panel is formed from a material stretchable in only a substantially longitudinal direction.

6. The torso support for pregnant women of claim 1, wherein said back support panel has arcuate left and right side edges extending in close conformance along respective arcuate peripheral edge portions of said left and right shoulder openings.

7. The torso support for pregnant women of claim 1, wherein said abdominal support panel tapers in width from a widest central front portion toward narrowest near portions at said left and right side edges.

8. The torso support for pregnant women of claim 1, wherein said breast support panel tapers in width from a widest central front portion toward narrower near portions at said left and right side edges.

9. The torso support for pregnant women of claim 1, wherein said upper elastic strip is stretchable only in a substantially lateral direction.

10. The torso support for pregnant women of claim 1, wherein said abdominal and breast support panels are stretchable in lateral and longitudinal directions, said upper elastic strip is stretchable only in a substantially lateral direction, and said back support panel is stretchable only in a substantially longitudinal direction.

11. A torso support for pregnant women, comprising:

a garment formed from a stretchable material having front and back portions, an upper neck opening, a lower waist opening and left and right shoulder openings; and a back support panel in said back portion of said garment, said back support panel stretchable in only a substantially longitudinal direction such that a wearer's back is supported in a substantially straight condition whereby back strain is substantially eliminated;

said back support panel possessing arcuate left and right side edges extending in close conformance along respective arcuate peripheral edge portions of said left and right shoulder openings;

said back support panel tapering in width from a widest upper portion to a narrower lower portion; and a lower elastic strip secured around said lower waist opening of said garment and to said lower portion of said back support panel.

12. The torso support for pregnant women of claim 11, further comprising a laterally extending upper elastic strip dividing said garment into an upper breast support region and a lower abdominal support region.

13. The torso support for pregnant women of claim 12, wherein said upper elastic strip is stretchable only in a substantially lateral direction.

14. A torso support for pregnant women, comprising:

an abdominal support panel tapering in width from a widest central front portion toward narrowest opposite left and right side edges, said abdominal support panel formed from a woven cotton blend fabric material stretchable in longitudinal and lateral directions;

a breast support panel possessing a substantially laterally extending lower edge sewn to a substantially laterally extending upper edge of said abdominal support panel, said breast support panel formed from a woven cotton blend fabric material stretchable in longitudinal and lateral directions;

an upper elastic strip stretchable in only a substantially lateral direction extending along the junction of said lower edge of said breast support panel and said upper edge of said abdominal support panel;

a generally hexagonal back support panel possessing a substantially laterally extending top edge disposed between arcuate left and right side edges and substantially straight, downwardly converging left and right lateral edges extending respectively from said arcuate left and right side edges to a bottom arcuate edge, said back support panel formed from a woven material stretchable in only a substantially longitudinal direction;

left and right side edges of said breast support panel sewn respectively to upper portions of said left and right lateral edges of said back support panel;

said left and right side edges of said abdominal support panel sewn respectively to lower portions of said left and right lateral edges of said back support panel;

opposite ends of said upper elastic strips secured respectively to a central region of said left and right lateral edges of said back support panel;

a lower elastic strip sewn around a bottom edge of said abdominal support panel, said lower elastic strip stretchable in only a substantially lateral direction, said lower elastic strip sewn along said bottom arcuate edge of said back support panel, said lower elastic strip having a width substantially greater than a width of said upper elastic strip;

left and right shoulder straps extending from a front of said breast support panel to a central upper region on a back of said torso support, above said back support panel;

said torso support possessing scoop back and scoop front portions forming a head and neck opening bounded by said shoulder straps;

said torso support possessing left and right shoulder openings partially bounded by said shoulder straps, said left and right shoulder openings possessing arcuate peripheral edge portions extending in close conformance with said arcuate left and right side edges of said back support panel and respectively secured thereto;

said top edge of said back support panel extending laterally across said central upper region on said back of said torso support, between said shoulder openings; and each of said shoulder openings surrounded by an elastic peripheral edge border stretchable in only a direction substantially along the peripheral edge of the opening.

* * * * *